US010167103B2

(12) United States Patent
Harashina

(10) Patent No.: US 10,167,103 B2
(45) **Date of Patent: *Jan. 1, 2019**

(54) PRINTING APPARATUS, CONTROL METHOD AND NON-TEMPORARY RECORDING MEDIUM

(71) Applicant: TOSHIBA TEC KABUSHIKI KAISHA, Shinagawa-ku, Tokyo (JP)

(72) Inventor: Hiromasa Harashina, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 131 days.

This patent is subject to a terminal disclaimer.

(21) Appl. No.: 15/258,162

(22) Filed: Sep. 7, 2016

(65) Prior Publication Data

US 2016/0375704 A1 Dec. 29, 2016

Related U.S. Application Data

(63) Continuation of application No. 14/691,692, filed on Apr. 21, 2015, now Pat. No. 9,457,925.

(51) Int. Cl.

| | |
|---|---|
| ***B65C 9/42*** | (2006.01) |
| ***B41J 3/407*** | (2006.01) |
| ***B65C 9/00*** | (2006.01) |
| ***B41J 11/42*** | (2006.01) |
| ***B65C 9/40*** | (2006.01) |
| *B41J 3/01* | (2006.01) |

(52) U.S. Cl.

CPC ..... *B65C 9/42* (2013.01); *B41J 3/4075* (2013.01); *B41J 11/42* (2013.01); *B65C 9/40* (2013.01); *B41J 3/01* (2013.01); *B65C 2009/0084* (2013.01); *B65C 2210/0094* (2013.01)

(58) Field of Classification Search

CPC .... B65C 2009/0084; B65C 2210/0094; B65C 9/42; B41J 11/36; B41J 11/42

See application file for complete search history.

(56) References Cited

U.S. PATENT DOCUMENTS

| | | | | |
|---|---|---|---|---|
| 5,049,228 | A | 9/1991 | Sato | |
| 2005/0190368 | A1 | 9/2005 | Ehrhardt et al. | |
| 2013/0108346 | A1* | 5/2013 | Preliasco | B41J 17/02 400/611 |
| 2015/0273882 | A1 | 10/2015 | Akahori et al. | |

FOREIGN PATENT DOCUMENTS

| | | |
|---|---|---|
| JP | 7-1802 | 1/1995 |
| JP | 2001-328302 | 11/2001 |
| JP | 2002-104354 | 4/2002 |
| JP | 2005-313410 | 11/2005 |

OTHER PUBLICATIONS

Non-Final Office Action for U.S. Appl. No. 14/691,692 dated Jan. 7, 2016.

* cited by examiner

*Primary Examiner* — Daniel J Colilla

(74) *Attorney, Agent, or Firm* — Amin, Turocy & Watson LLP

(57) ABSTRACT

In accordance with one embodiment, a printing apparatus comprises a conveyance path, a detection section and a control section. The conveyance path conveys a mount to which labels are attached. The detection section detects the existence of the label peeled off by a peeling bar which peels off the label attached to the mount. The control section controls start time of back feed of the mount in a case in which it is detected that the label is taken away.

10 Claims, 7 Drawing Sheets

FIG.4

| LABEL SIZE | START TIME | |
|---|---|---|
| a | t0 | 30 |
| b | t1 | 30 |
| ⋮ | ⋮ | |

| PITCH | START TIME | |
|---|---|---|
| aa | t0 | 40 |
| bb | t1 | 40 |
| ⋮ | ⋮ | |

FIG.8

| GAP | START TIME | |
|---|---|---|
| aaa | t0 | 50 |
| bbb | t1 | 50 |
| ⋮ | ⋮ | |

PRINTING APPARATUS, CONTROL METHOD AND NON-TEMPORARY RECORDING MEDIUM

CROSS-REFERENCE TO RELATED APPLICATIONS

This application is a Continuation of application Ser. No. 14/691,692 filed on Apr. 21, 2015, the entire contents of which are incorporated herein by reference.

FIELD

Embodiments described herein relate generally to a printing apparatus, a control method and a non-temporary recording medium.

BACKGROUND

Conventionally, the existence of a peeled label in a peeling unit arranged in a printing apparatus such as a barcode printer and the like is detected in the following way. First, the printing apparatus bends amount to which the label is attached at an acute angle with a peeling bar to peel off the label excluding the rear end part of the label from the mount. Next, the printing apparatus stops the operation in a state in which the rear end part of the label is left on the peeling bar, and then detects the existence of the label (hereinafter referred to as a "peeled label") that is peeled through a sensor. If a user takes the peeled label away from the mount, the printing apparatus detects that the peeled label is taken away by the sensor. In this way, the existence of the peeled label is detected. Sequentially, if there is next printing data in the printing apparatus, the printing apparatus executes the back feed of the mount after a pre-determined time since it is detected that the peeled label is taken away to start the printing of the next label.

However, there is a case in which it is difficult to peel off the label from the mount according to the size of the label. In this case, the sensor may detect that the peeled label is taken away and therefore the printing of the next label may be started during the peeling of the label. As a result, the peeled label may be pulled back into the printing apparatus through the back feed, which may lead to a risk that the peeled label is damaged.

BRIEF DESCRIPTION OF THE DRAWINGS

FIG. 4 is a diagram illustrating a specific example of a back feed information table;

FIG. 8 is a diagram illustrating a specific example of the back feed information table in a second method.

DETAILED DESCRIPTION

In accordance with one embodiment, a printing apparatus comprises a conveyance path, a detection section and a control section. The conveyance path conveys a mount to which labels are attached. The detection section detects the existence of the label peeled off by a peeling bar which peels off the label attached to the mount. The control section controls start time of back feed of the mount in a case in which it is detected that the label is taken away.

Hereinafter, the printing apparatus according to the embodiment is described with reference to the accompanying drawings.

Figure 1:
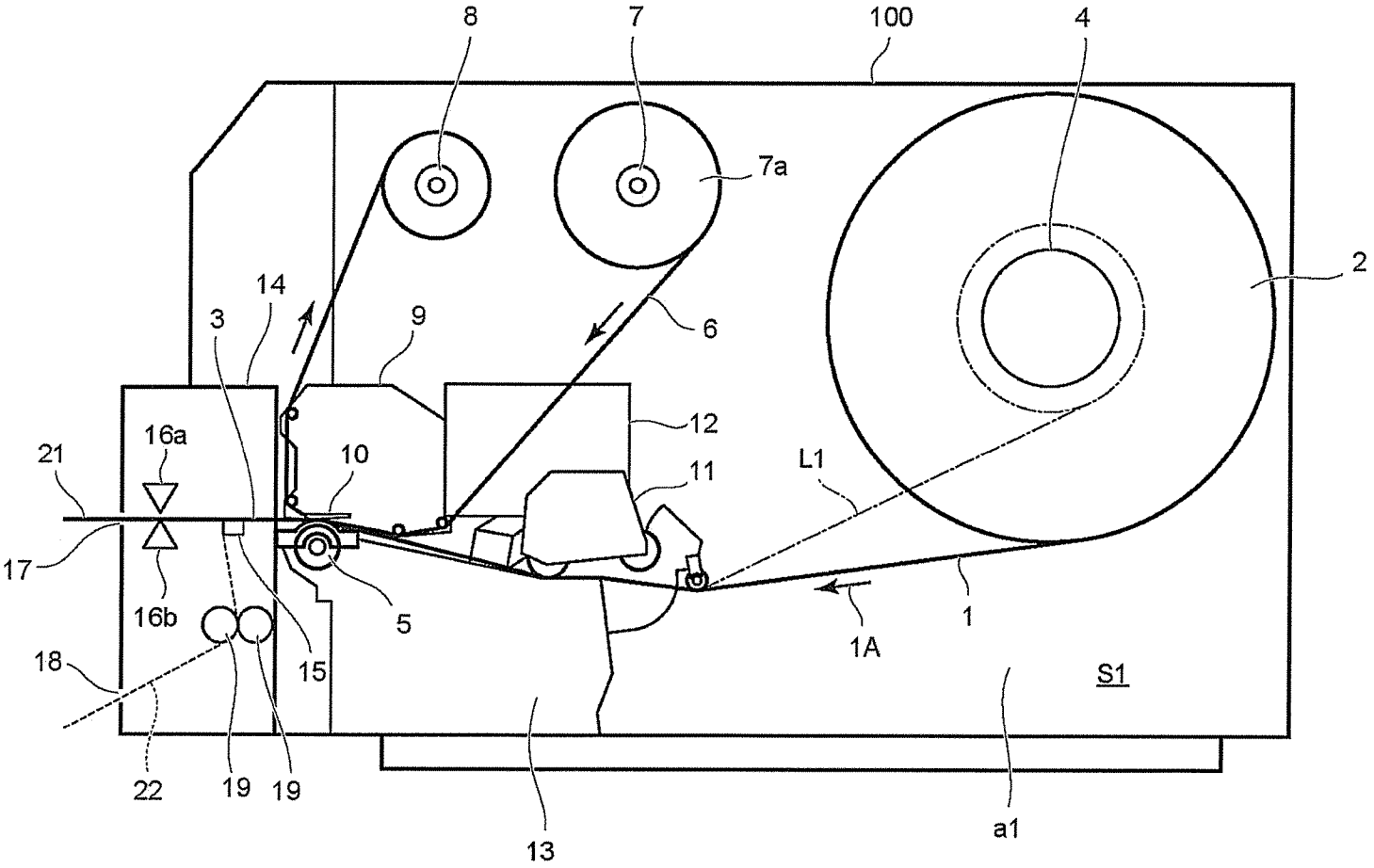
FIG. 1 is a side view illustrating an example of the internal constitution of a printing apparatus 100 according to one embodiment.
Figure 2:
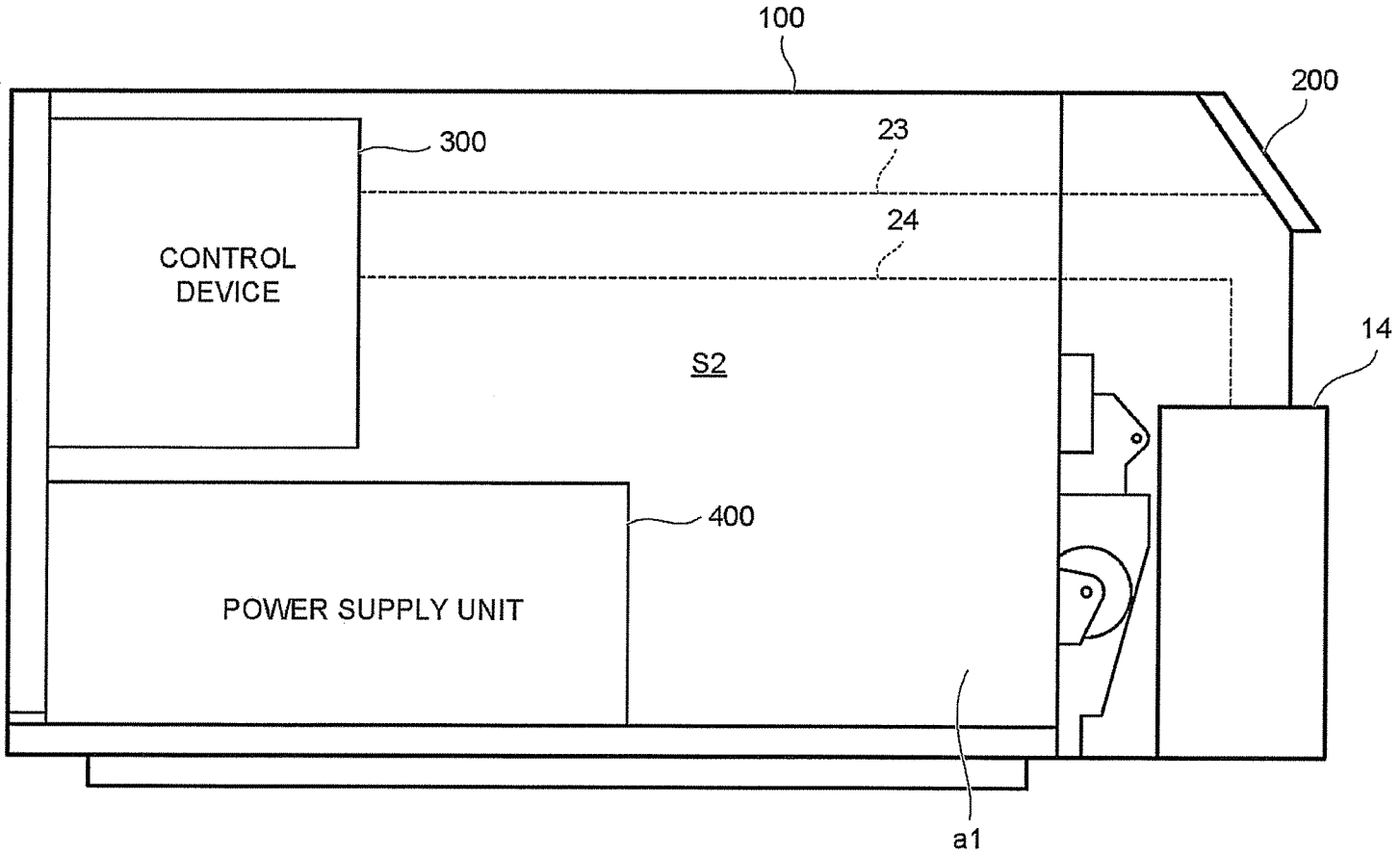
FIG. 2 is a side view illustrating an example of the internal constitution of the printing apparatus 100 according to the embodiment.

FIG. 1 and FIG. 2 are side views illustrating an example of the internal constitution of a printing apparatus 100 according to the embodiment. In FIG. 1 and FIG. 2, the internal constitutions of the printing apparatus 100 are viewed from different lateral sides. As shown in FIG. 1 and FIG. 2, the printing apparatus 100 includes a first chamber S1 and a second chamber S2 in housing. The first chamber S1 and the second chamber S2 are divided by a vertical wall a1. First, the constitution in the first chamber S1 is described with reference to FIG. 1.

The printing apparatus 100 holds a roll portion 2 obtained by winding label roll paper 1 in a roll shape. The label roll paper 1 in the embodiment is label paper formed by attaching a plurality of labels onto a strip mount. The printing apparatus 100 draws the label roll paper 1 from the roll portion 2 and carries out printing on the label of the drawn out label roll paper 1.

An example of internal winding label roll paper obtained by winding the label roll paper 1 in a state in which the label serves as the inner side of the mount is shown in FIG. 1. The label roll paper 1 indicated by a solid line in FIG. 1 is the label roll paper 1 in a state in which the diameter of the roll portion 2 is relatively large. On the other hand, one dotted line L1 in FIG. 1 indicates the position of the label roll paper 1 in a state in which the diameter of the roll portion 2 is relatively small. Further, an arrow 1A shown in FIG. 1 refers to the feeding direction of the label roll paper 1.

As shown in FIG. 1, in the first chamber S1, a roll holding shaft 4, a platen roller 5, a feeding shaft 7 of an ink ribbon 6, a winding shaft 8 of the ink ribbon 6, a head block 9, a thermal head 10 and a roller block 11 are arranged substantially perpendicular to the vertical wall a1. The head block 9 and the roller block 11 are integrated to constitute a movable block 12 serving as a movable section.

A fixed block 13 including the platen roller 5 is arranged in the first chamber S1. The movable block 12 and the fixed block 13 are arranged opposite to each other. A conveyance path 3 for conveying the label roll paper 1 is arranged between the movable block 12 and the fixed block 13.

The roll holding shaft 4 holds the label roll paper 1 wound in a roll shape in such a manner that the label roll paper 1 can be drawn out and fed. Specifically, the roll holding shaft 4 holds the roll portion 2 of the label roll paper 1 in such a manner that the roll portion 2 can rotate around the shaft perpendicular to the vertical wall a1. The roll holding shaft 4 and the roll portion 2 are not driven by a motor and the like. The roll portion 2 of the label roll paper 1 is rotated through the rotation of the platen roller 5, and in this way, the label roll paper 1 is drawn out from the roll portion 2.

The platen roller 5 is driven to rotate by a rotary drive mechanism (not shown) including a motor (not shown) such as a stepping motor, a gear, a belt and the like. The platen roller 5 is arranged opposite to the thermal head 10. The drawn out label roll paper 1 is pressed against the platen roller 5 by the thermal head 10 which is energized by an elastic member. Through such a structure, the platen roller 5 and the thermal head 10 nip the drawn out label roll paper 1. Then the platen roller 5 driven by the rotary drive mechanism draws out the label roll paper 1 held by the roll holding shaft 4 and conveys it on the conveyance path 3. In the following description, a mechanism constituted by the platen roller 5, the rotary drive mechanism and the motor is referred to as a conveyance mechanism.

A roll portion (hereinafter referred to as a "ribbon roll") 7*a* of the ink ribbon 6 is set on the feeding shaft 7 of the ink ribbon 6. The winding shaft 8 is driven to rotate by a rotary drive mechanism (not shown) including a motor (not shown), a gear, a belt and the like. The ink ribbon 6 is drawn out from the ribbon roll 7*a* and wound around the winding shaft 8 through the rotation of the winding shaft 8. The ink ribbon 6 is nipped between the thermal head 10 and the platen roller 5 together with the label roll paper 1.

The thermal head 10 is arranged above the platen roller 5 and opposite to the platen roller 5. The thermal head 10 carries out printing on the label attached to the mount of the label roll paper 1 drawn out by the platen roller 5. The thermal head 10 is arranged in such a manner that it can be contacted with and separated from the platen roller 5. The thermal head 10 is energized to the platen roller 5 by the elastic member. The thermal head 10 energized by the elastic member presses the label roll paper 1 conveyed between the thermal head 10 and the platen roller 5 against the platen roller 5. The thermal head 10 includes a plurality of heat generating elements arranged in a line, and selectively energizes the plurality of heat generating elements to generate heat through the heat generating elements. The thermal head 10 melts or sublimates the ink of the ink ribbon 6 through the heat generated by the heat generating elements and transfers the ink to the label attached to the mount of the label roll paper 1 to carry out printing. In the following description, a mechanism constituted by the platen roller 5, the ink ribbon 6, the feeding shaft 7, the winding shaft 8, the rotary drive mechanism, the thermal head 10 and the motor controller (not shown) is referred to as a printing mechanism.

A peeling unit 14 is arranged in the printing apparatus 100. The peeling unit 14 peels off the label from the label roll paper 1 conveyed on the conveyance path 3. The peeling unit 14 includes a peeling plate (peeling bar) 15, a sensor 16*a*, a sensor 16*b*, a discharge port 17, a discharge port 18 and a mount conveyance roller 19.

The peeling plate 15 is arranged at the front side of the flat printing mechanism, that is, the front side in the feeding direction of the label roll paper 1 to be basically in a right angle against the feeding direction of the label roll paper 1.

The sensor 16*a* is a light emitting section which emits light to the conveyance path 3.

The sensor 16*b* is a light receiving section which receives light emitted from the sensor 16*a*. The sensor 16*b* detects a voltage level corresponding to the quantity of the received light.

The discharge port 17 discharges a peeled label 21 peeled off by the peeling plate 15.

The discharge port 18 discharges a mount 22 (hereinafter referred to as a "peeled mount") from which the label is peeled off by the peeling plate 15.

The mount conveyance roller 19 is driven to rotate by a rotary drive mechanism (not shown) including a motor (not shown), a gear, a belt and the like. The peeled mount is conveyed to the discharge port 18 through the rotation of the mount conveyance roller 19.

Next, the constitution in the second chamber S2 is described with reference to FIG. 2.

As shown in FIG. 2, a control device 300 and a power supply unit 400 are housed in the second chamber S2. The control device 300 controls the whole operations of the printing apparatus 100. For example, the control device 300 controls the motor and the rotary drive mechanism to control the mount conveyance roller 19, the conveyance mechanism and the printing mechanism. Further, the motor and the rotary drive mechanism (though not shown in FIG. 2) are arranged in the second chamber S2. The power supply unit 400 supplies power to the printing apparatus 100. A dashed line 23 indicates a route where data passes between a display section 200 and the control device 300 of the printing apparatus 100. A dashed line 24 indicates a route where data passes between the control device 300 and the peeling unit 14.

The display section 200 is an image display device such as a liquid crystal display, an organic EL (Electro Luminescence) display and the like. The display section 200 operates as an output interface to display characters and images. The display section 200 further operates as an input interface to receive an input of an instruction form a user. The instruction input to the display section 200 is notified to the control device 300.

Next, the schematic operation of the printing apparatus 100 according to the embodiment is described.

If it is instructed to issue a label, the printing apparatus 100 prints pre-determined data on the label and then issues the printed label. The label issued from the printing apparatus 100 is discharged form the discharge port 17 in a state of being peeled off by the peeling unit 14 as stated above. At this time, the printing apparatus 100 stops the operation in a state in which the rear end part of the label is left on the peeling plate 15. The printing apparatus 100 detects the existence of the peeled label 21 through the voltage level regularly detected by the sensor 16*b*. The printing apparatus 100 starts the back feed of the mount if a certain time elapses since it is detected that the peeled label 21 is taken away. The back feed means reversely conveying the label roll paper 1 to return the printing position of the label to a suitable position before the next label is issued. In a case of carrying out back feed, the printing apparatus 100 controls the conveyance mechanism to carry out a processing opposite to that carried out in a case of carrying out printing on the label. Specifically, the printing apparatus 100 rotates the platen roller 5 in a direction opposite to the conveyance direction of the label roll paper 1. In this way, the label roll paper 1 is pulled back in a direction opposite to the conveyance direction. The printing apparatus 100 according to the embodiment controls the start time of the back feed. The processing is carried out by the control device 300. Hereinafter, the control device 300 is described in detail.

Figure 3:
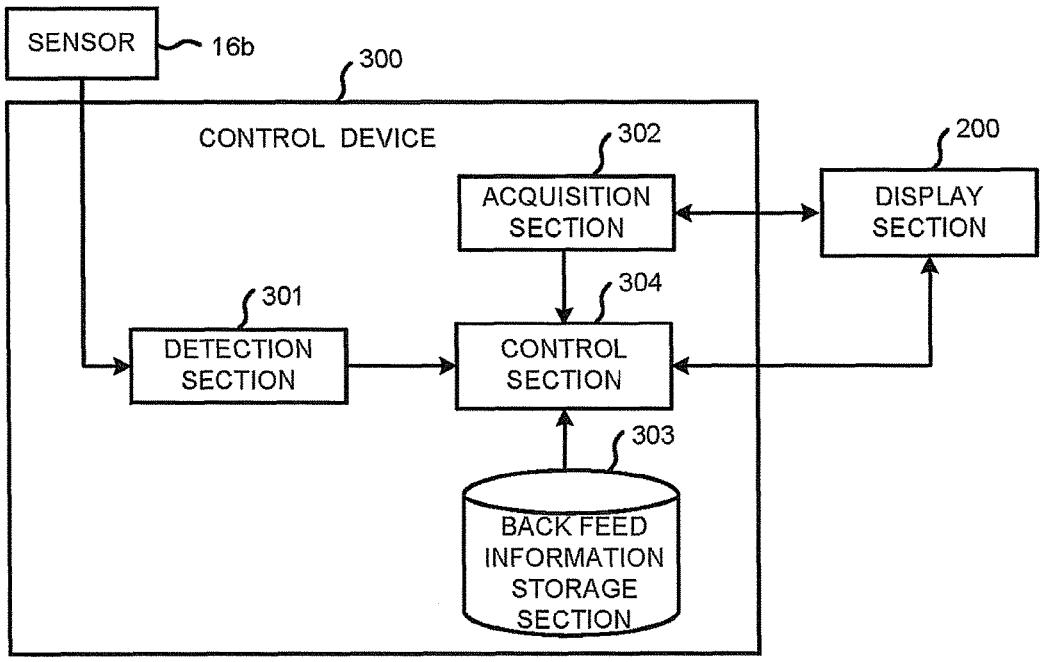
FIG. 3 is a schematic block diagram illustrating the functional components of a control device 300.

FIG. 3 is a schematic block diagram illustrating the functional components of the control device 300.

The control device 300, which is equipped with a CPU (Central Processing Unit), a memory and an auxiliary storage device and the like connected through a bus line, executes a control program to function as a device provided with a detection section 301, an acquisition section 302, a back feed information storage section 303 and a control section 304. All or part of the functions of the control device 300 may be realized using hardware such as ASIC (Application Specific Integrated Circuit), PLD (Programmable Logic Device), FPGA (Field Programmable Gate Array) and the like. The control program may be recorded in a computer-readable recording medium. The computer-readable recording medium includes a portable medium such as flexible disk, magnetic optical disk, ROM, CD-ROM and the like, and a storage device such as a hard disk arranged inside a computer system. The control program may be sent or received through an electric communication line.

The detection section 301 detects the existence of the peeled label 21 according to the voltage level detected by the sensor 16*b*. Specifically, in a case in which the voltage level is below a pre-determined threshold value, the detection section 301 detects that the peeled label 21 exists. On the other hand, in a case in which the voltage level is higher than the pre-determined threshold value, the detection section 301 detects that there is no peeled label 21.

The acquisition section 302 acquires instruction information input to the display section 200 by a user. The instruction information includes, for example, a label issuing instruction, a label size and the like.

The back feed information storage section 303 consists of a storage device such as a magnetic hard disk device or a semiconductor storage device and the like. The back feed information storage section 303 stores a back feed information table. The back feed information table consists of a record (hereinafter referred to as a "back feed information record") including the information relating to the start time of the back feed.

FIG. 4 is a diagram illustrating a specific example of the back feed information table. The back feed information table includes a plurality of back feed information records 30. The back feed information record 30 includes each value of the label size and the start time. The value of the label size indicates the size of the label attached to the mount of the label roll paper 1. In a case of the label size of the same back feed information record 30, the value of the start time indicates the time since it is detected that the peeled label 21 is taken away till the start of the back feed. In the back feed information table, as to the label size, the more difficult it is to peel off the label of the label size from the mount, the longer the start time is set. The label size that is difficult to be peeled off from the mount refers to such a label size that the user has to take a lot of time to peel off the label of this size from the mount. As a specific example of the label size that is difficult to be peeled off from the mount, a label size larger than a first threshold value and smaller than a second threshold value can be listed.

In the example shown in FIG. 4, the information of a plurality of label sizes is registered in the back feed information table. These label sizes are "a", "b", " . . . ". In FIG. 4, in the back feed information record 30 recorded at the first stage of the back feed information table, the value of the label size is "a", and the value of the start time is "t0". That is, in a case of a label size "a", the time since it is detected that the peeled label 21 is taken away till the start of the back feed is "t0".

Return to FIG. 3 to continue the description of the control device 300.

The control section 304 controls each function section of the control device 300, the motor and the rotary drive mechanism. For example, in a case in which it is detected that the label is taken away, the control section 304 controls the start time of the back feed of the mount based on the information (hereinafter referred to as "label information") of the acquired label size.

Figure 5:
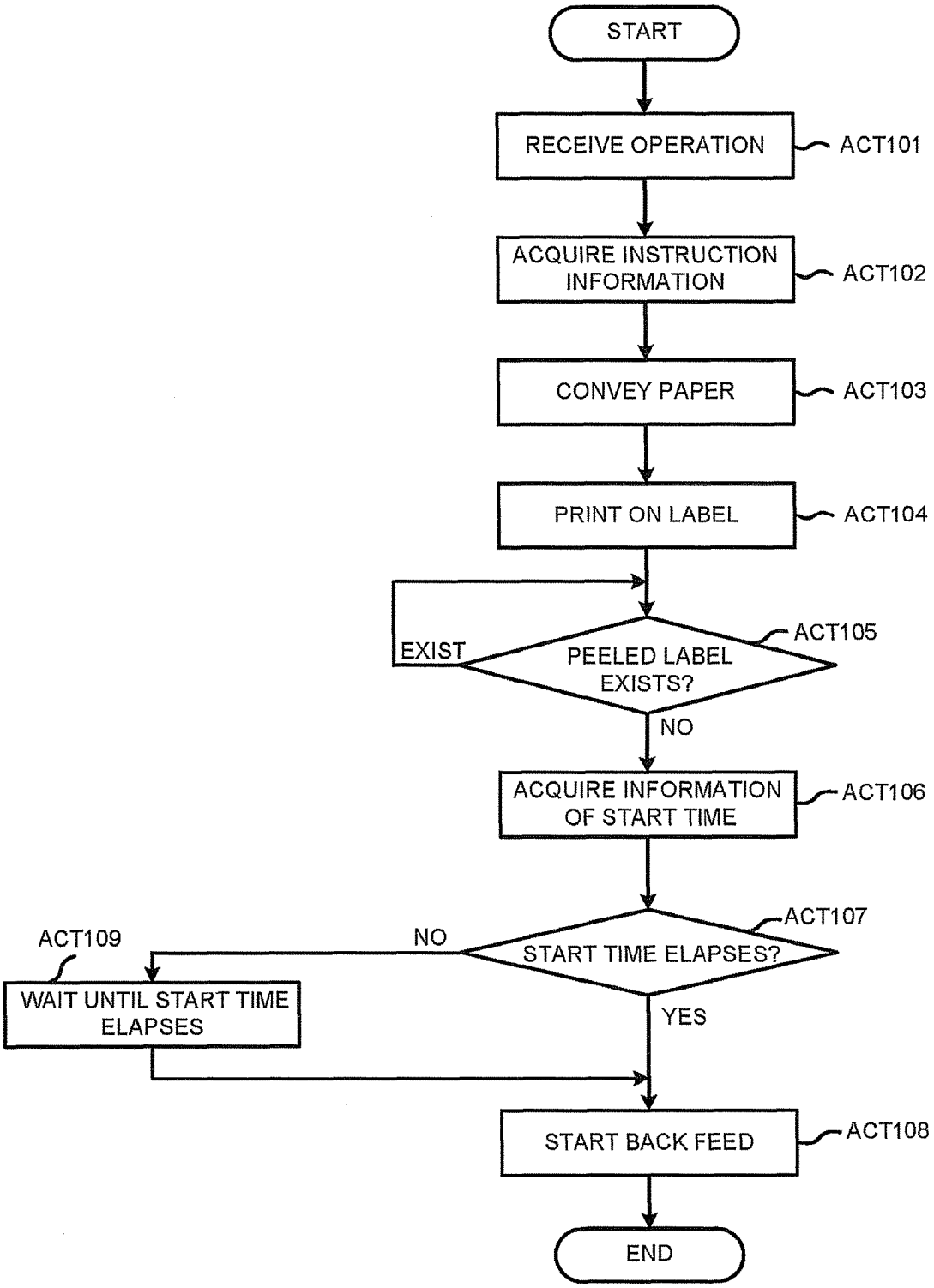
FIG. 5 is a flowchart illustrating the operation of the printing apparatus 100.

FIG. 5 is a flowchart illustrating the operation of the printing apparatus 100.

The display section 200 receives an operation from the user (ACT 101). In a case in which the user operates the display section 200 to input the instruction information, the input instruction information is notified to the control device 300. The acquisition section 302 acquires the notified instruction information (ACT 102). After the acquisition section 302 acquires the instruction information, the control section 304 controls the conveyance mechanism to convey the label roll paper 1 (ACT 103).

Next, the control section 304 controls the printing mechanism to print the printing data on the label attached to the mount of the label roll paper 1 (ACT 104). When the label roll paper 1 is conveyed to the peeling unit 14 through the conveyance path 3, the label of the label roll paper 1 is peeled off from the mount by the peeling plate 15. Sequentially, the peeled label 21 is discharged from the discharge port 17 through the conveyance path 3. At this time, the control section 304 stops the operation in a state in which the rear end part of the peeled label 21 is left on the peeling plate 15. The peeled mount is conveyed by the mount conveyance roller 19 to the discharge port 18 and then discharged from the discharge port 18.

The detection section 301 detects the existence of the peeled label based on the detection result from the sensor 16*b* (ACT 105). In a case in which the peeled label 21 exists ("EXIST" in ACT 105), the control device 300 executes the processing in ACT 104 repeatedly.

On the other hand, in a case in which there is no peeled label 21 ("NO" in ACT 105), the control section 304 acquires the information of the start time based on the instruction information acquired in the processing in ACT 102 (ACT 106). Specifically, first, the control section 304 reads the back feed information table stored in the back feed information storage section 303. Next, the control section 304 selects the back feed information record 30 corresponding to the label information contained in the instruction information within the items of the label sizes in the back feed information table. Then the control section 304 acquires the value of the item of start time of the selected back feed information record 30.

Then the control section 304 determines whether or not the acquired start time elapses since it is detected that the peeled label is taken away (ACT 107). In a case in which the start time elapses (YES in ACT 107), the control section 304 controls the conveyance mechanism to start the back feed (ACT 108).

On the other hand, in a case in which the start time does not elapse (NO in ACT 107), the control device 300 waits until the start time elapses (ACT 109). Then after the start time elapses, the control section 304 controls the conveyance mechanism to start the back feed (ACT 108).

In the printing apparatus 100 with such a constitution, it is possible to reduce the possibility that the peeled label is damaged. Hereinafter, the effect is described in detail. In the printing apparatus 100 according to the embodiment, the start time of back feed is set for each label size. In this way, the back feed is started at different time for each label size. Particularly, as to the label that is difficult to be peeled off from the mount, the start time of back feed is set to be longer compared with the label of other sizes. This is because the more difficult it is to peel off the label of the label size from the mount, the longer the time taken to peel off the label from the mount is. Thus, during the peeling of the label that is difficult to be peeled off from the mount, the time till the back feed is carried out can be delayed even if it is detected that the peeled label is taken away. Thus, it is possible to reduce the possibility that the peeled label is damaged.

Hereinafter, a modification of the printing apparatus 100 is described.

A reflection type sensor may be used instead of the transmission type sensor including the sensor 16*a* and the sensor 16*b* to detect the existence of the peeled label 21.

The length in the width direction of the label may be included as the value of the label size of the back feed information table. The width direction of the label refers to a direction perpendicular to the conveyance direction of the label. It is considered that the longer the length in the width direction of the label is, the longer the time taken for the user to peel off the label from the mount is. Thus, the longer the length in the width direction of the label is, the longer the start time of back feed is set to be.

The control section 304 may control the start time of back feed of the mount in the following way. Hereinafter, detailed description is provided with reference to FIG. 6-FIG. 8.

Figures 6, 7:
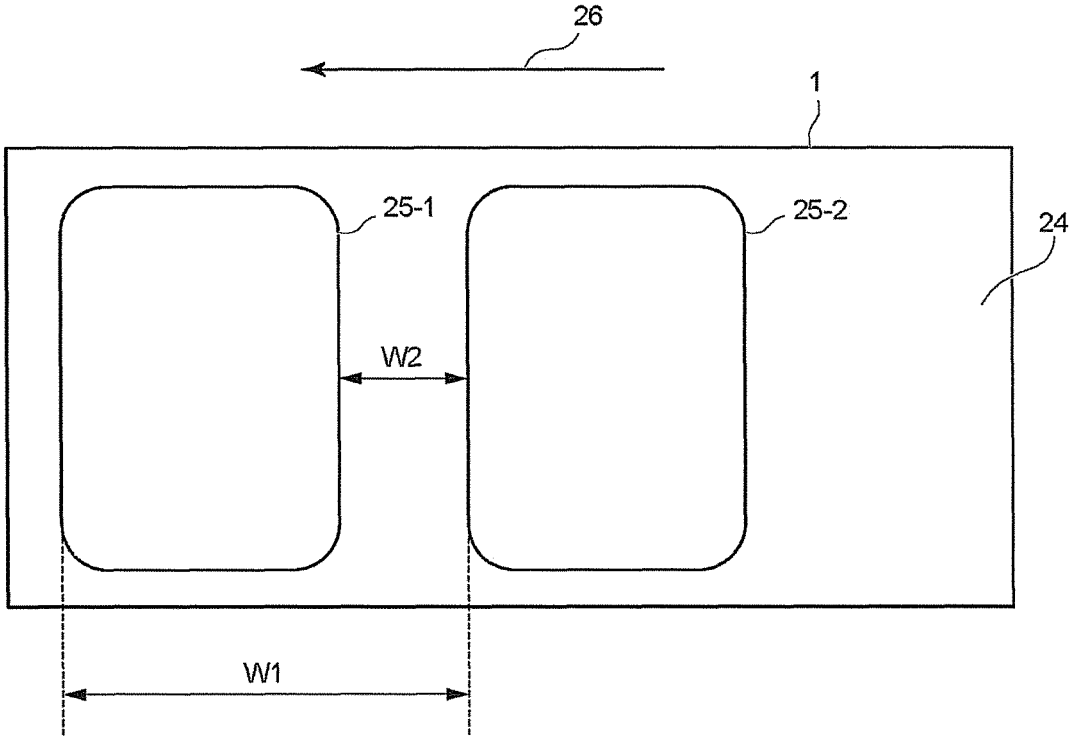
FIG. 6 is a schematic view illustrating other method for controlling start time of back feed.
FIG. 7 is a diagram illustrating a specific example of the back feed information table in a first method.

FIG. 6 is a schematic view illustrating other method for controlling the start time of back feed.

In FIG. 6, the two labels, that is, label 25-1 and label 25-2, are attached to a mount 24 of the label roll paper 1. In the following description, the label 25-1 is referred to as a former printing label (first label), and the label 25-2 is referred to as a later printing label (second label). The direction indicated by an arrow 26 indicates the conveyance direction of the label roll paper 1.

A First Method

The control section 304 controls the start time of back feed of the mount based on a length (hereinafter referred to as a "pitch") W1 from the front end of the former printing label to the front end of the later printing label. The pitch W1 may be input by the user or measured by a sensor. In this case, the information shown in FIG. 7 is registered in the back feed information table.

FIG. 7 is a diagram illustrating a specific example of the back feed information table in the first method. The back feed information table in the first method includes a plurality of back feed information records 40. The back feed information record 40 includes each value of the pitch and the start time. The value of the pitch indicates the length (W1) from the front end of the former printing label to the front end of the later printing label. In a case of the pitch of the same back feed information record 40, the value of the start time indicates the time since it is detected that the peeled label 21 is taken away till the start of the back feed. The shorter the pitch W1 is, the longer the start time is.

With such a constitution, the start time of back feed can be controlled using a method other than the label size. In the first method, the start time of back feed is set for each pitch W1. In this way, the back feed is started at different time according to the attachment interval between the labels. Particularly, the shorter the pitch W1 is, the longer the start time of back feed is. This is because it is considered that the shorter the pitch W1 is, the more difficult it is to peel off the label from the mount. Thus, in a case in which the pitch W1 is short, the time till the back feed is carried out can be delayed even if it is detected that the peeled label 21 is taken away. Thus, it is possible to reduce the possibility that the peeled label 21 is damaged.

A Second Method

The control section 304 controls the start time of back feed of the mount based on a length (hereinafter referred to as a "gap") W2 between the former printing label and the later printing label. The gap W2 may be input by the user or measured by a sensor. In this case, the information shown in FIG. 8 is registered in the back feed information table.

FIG. 8 is a diagram illustrating a specific example of the back feed information table in the second method. The back feed information table in the second method includes a plurality of back feed information records 50. The back feed information record 50 includes each value of the gap and the start time. The value of the gap indicates the length (W2) between the former printing label and the later printing label. In a case of the gap of the same back feed information record 50, the value of the start time indicates the time since it is detected that the peeled label 21 is taken away till the start of the back feed. The shorter the gap W2 is, the longer the start time is. Further, the longer the gap W2 is, the shorter the start time is.

With such a constitution, the start time of back feed can be controlled using a method other than the label size. In the second method, the start time of back feed is set for each gap W2. In this way, the back feed is started at different time according to the attachment interval between the labels. Particularly, the shorter the gap W2 is, the longer the start time of back feed is. This is because it is considered that the shorter the gap W2 is, the more difficult it is to peel off the label from the mount. Thus, in a case in which the gap W2 is short, the time till the back feed is carried out can be delayed even if it is detected that the peeled label 21 is taken away. Thus, it is possible to reduce the possibility that the peeled label is damaged.

Further, the longer the gap W2 is, the shorter the start time of back feed is set to be. This is because it is considered that the longer the gap W2 is, the easier it is to peel off the label from the mount. Thus, in a case in which the gap W2 is long, the time till the back feed is carried out can be shortened even if it is detected that the peeled label 21 is taken away. In this way, in a case of carrying out printing on a plurality of labels, it is possible to reduce the time taken in the whole processing.

The printing apparatus 100 may be provided with a button (hereinafter referred to as a "start button") for starting the back feed. In this case, the control section 304 controls to start the back feed of the mount in a case in which it is detected that the peeled label 21 is taken away and the start button is pressed. The start button may be displayed on the screen of the display section 200, or arranged in the printing apparatus 100 as a hard key.

With such a constitution, the back feed can be carried out with the convenience of user taken into account. Particularly, it is possible to carry out the back feed after the user is aware that the peeled label 21 is taken away, which can further reduce the possibility that the peeled label 21 is damaged.

In a case in which the start button is pressed before the preset start time elapses since it is detected that the peeled label 21 is taken away, the control section 304 controls to start the back feed at that time.

In accordance with at least one embodiment described above, the printing apparatus is provided with a detection section for detecting the existence of the peeled label and a control section for controlling to start the back feed of the paper 1 in a case in which it is detected that the peeled label is taken away, and in this way, it is possible to reduce the risk that the peeled label is damaged.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printing apparatus comprising:

a detection section configured to at least detect that a label is completely peeled from a mount;

a control section configured to:

start a back feed of the mount after elapse of a start time period, and control a value of the start time period; and wherein the start time period is a time period since it is detected that the label was completely peeled from the mount.

2. The printing apparatus according to claim 1, further comprising:

a first storage section configured to store the size of the label and the start time period of back feed in an associated manner; wherein the control section controls to start the back feed of the mount after the start time period of back feed corresponding to the size of the label elapses since it is detected that the label is taken away.

3. The printing apparatus according to claim 1, further comprising:

a storage section configured to store a length from the front end of a first label attached to the mount to the front end of a second label attached following the first label and the start time period of back feed in an associated manner; wherein the control section controls to start the back feed of the mount after the start time period of back feed corresponding to the length from the front end of the first label to the front end of the second label elapses since it is detected that the label is taken away.

4. The printing apparatus according to claim 3, wherein the start time period of back feed is associated with the length from the front end of the first label to the front end of the second label in the second storage section in such a manner that the shorter the length is, the longer the start time period of back feed is.

5. The printing apparatus according to claim 1, further comprising:

a storage section configured to store a length between a first label attached to the mount and a second label attached following the first label and the start time period of back feed in an associated manner; wherein the control section controls to start the back feed of the mount after the start time period of back feed corresponding to the length between the first label and the second label elapses since it is detected that the label is taken away.

6. The printing apparatus according to claim 5, wherein the start time period of back feed is associated with the length between the first label and the second label in the third storage section in such a manner that the shorter the length is, the longer the start time period of back feed is.

7. The printing apparatus according to claim 1, further comprising:

a start button configured to be operated for starting the back feed; wherein the control section controls to start the back feed of the mount in a case in which it is detected that the label is taken away and the start button is pressed.

8. The printing apparatus according to claim 7, wherein the control section controls to start the back feed of the mount in a case in which the start button is pressed before the start time period of back feed elapses since it is detected that the label is taken away.

9. A control method comprising:

detecting that a label is completely peeled from a mount;

starting a back feed of the mount after elapse of a start time period;

controlling a value of the start time period; and wherein the start time period is a time period since it is detected that the label was completely peeled from the mount.

10. A non-transitory recording medium that stores a computer program which enables a computer to execute the following processing:

detecting that a label is completely peeled from a mount;

starting a back feed of the mount after elapse of a start time period;

controlling a value of the start time period; and wherein the start time period is a time period since it is detected that the label was completely peeled from the mount.

* * * * *